US006851356B2

(12) United States Patent
Haag

(10) Patent No.: US 6,851,356 B2
(45) Date of Patent: Feb. 8, 2005

(54) CALENDER AND PROCESS FOR ARRANGING ROLLS IN A ROLL STACK OF A CALENDER

(75) Inventor: Rolf Van Haag, Kerken (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/192,530

(22) Filed: Jul. 11, 2002

(65) Prior Publication Data

US 2003/0025230 A1 Feb. 6, 2003

(30) Foreign Application Priority Data

Jul. 12, 2001 (DE) ..... 101 33 891

(51) Int. Cl.[7] ..... B30B 3/04
(52) U.S. Cl. ..... 100/47; 100/163 R; 100/168
(58) Field of Search ..... 100/35, 41, 47, 100/155 R, 157, 150 R, 162 R, 162 B, 163 R, 168, 169, 176, 161, 164; 72/10.2, 10.3, 10.4, 172, 248, 247

(56) References Cited

U.S. PATENT DOCUMENTS

| | | | | | |
|---|---|---|---|---|---|
| 3,044,392 | A | | 7/1962 | Minarik | |
| 3,240,148 | A | * | 3/1966 | Varga | 100/158 R |
| 4,117,054 | A | * | 9/1978 | Salo | 264/40.1 |
| 4,348,952 | A | * | 9/1982 | Gooch | 100/158 R |
| 4,516,491 | A | * | 5/1985 | Winter | 100/158 R |
| 4,596,523 | A | | 6/1986 | Whitehead | 425/367 |
| 5,501,145 | A | * | 3/1996 | Fromm | 100/158 R |
| 5,961,899 | A | | 10/1999 | Rossetti et al. | |
| 6,199,476 | B1 | * | 3/2001 | Kayser | 100/35 |
| 6,305,280 | B1 | * | 10/2001 | Beckers | 100/331 |
| 2002/0060021 | A1 | | 5/2002 | Kayser et al. | |

FOREIGN PATENT DOCUMENTS

| | | |
|---|---|---|
| DE | 19601293 | 7/1997 |
| DE | 19815339 | 10/1999 |
| EP | 949378 | 10/1999 |
| EP | 1127977 | 8/2001 |
| WO | 99/25921 | 5/1999 |

OTHER PUBLICATIONS

Article by J. R. Parker et al. "Analysis and Control of Calender Barring" Pulp & Paper Canada, vol. 76, No. 10, Oct. 1975, pp. 89–91.

Article by J. B. A. Epton et al. "Glättwerk–Barring und Naβpressenvibration" Wochenblatt für Papierfabrikation 17, 1981, pp. 616–622.

Article by J. R. Parker "Investigation of Vibrations and Disturbances" Pulp & Paper Canada, vol. 80, No. 7, Jul. 1979, pp. 39–43.

(List continued on next page.)

*Primary Examiner*—Allen Ostrager
*Assistant Examiner*—Jimmy T Nguyen
(74) *Attorney, Agent, or Firm*—Greenblum & Bernstein, P.L.C.

(57) ABSTRACT

Calender with a roll stack and process for arranging rolls in a roll stack of a calender, the calender comprising two end rolls in a press plane and a plurality of middle rolls between the two end rolls. At least one of the middle rolls has an elastic surface and has a displacement (x) relative to the press plane, the size of the displacement (x) being selected based on a wavelength of a critical natural frequency within the roll stack. The end rolls and the at least one middle roll define two nips therebetween, the displacement (x) effecting a difference in distance of a fraction of a wavelength on a surface of the at least one middle roll between the two nips. An adjusting device adjusts the displacement of the at least one middle roll on the basis of a preset displacement (x), which depends on the wavelength.

28 Claims, 3 Drawing Sheets

OTHER PUBLICATIONS

Article by L. Huser et al. "Selbsterregte Schwingungen in Mehrwalzen–Glättwerken" Escher Wyss Mitteilungen 1/2, 1980, pp. 200–207.

"Calender barring on paper machines–practical conclusions and recommendations," Tappi Journal, vol. 58, No. 8, Aug. 1975, pp. 147–151.

"Barringbildung am Glattkalander einer Papiermaschine" Das Papier, Nr. 9, 1995, pp. 581–590.

"Calender Vibration—A Simulation Study and a Cure," Tappi Journal, vol. 52, No. 7, Jul. 1969, pp. 1356–1361.

"Calender barring on paper machines–practical conclusions and recommendations" Tappi Journal, vol. 58, No. 8, Aug. 1975, pp. 147–151.

* cited by examiner

CALENDER AND PROCESS FOR ARRANGING ROLLS IN A ROLL STACK OF A CALENDER

CROSS-REFERENCE TO RELATED APPLICATIONS

The present application claims priority under 35 U.S.C. §119 of German Patent Application No. 101 33 891.0, filed on Jul. 12, 2001, the disclosure of which is expressly incorporated by reference herein in its entirety.

BACKGROUND OF THE INVENTION

1. Field of the Invention

The invention relates to a calender with a roll stack which features two end rolls in the press plane and in between several middle rolls, at least one of which features an elastic surface. The invention further relates to a process for arranging rolls in a roll stack of a calender, which features two end rolls in a press plane and in between several middle rolls, at least one of which features an elastic surface and which runs in operation at a normal speed.

2. Discussion of Background Information

The invention is described below on the basis of a calender which is used for glazing paper or cardboard webs. However, it can also be used in the same way with other material webs with which similar problems occur.

When glazing a paper web, the paper web is guided through the calender and into nips that are formed between a hard and a soft roll, i.e., a roll with an elastic surface, and is acted upon by increased pressure and, if necessary, also by increased temperature. In the case of calenders of more recent construction types, e.g., the "Janus calenders," rolls are used that are covered with a plastic coating. It can now be observed that in many cases crosswise stripes occur on the paper web after a certain operating time. As soon as these crosswise stripes become visible, the paper web becomes useless and forms waste. The reasons for this so-called barring formation have not yet been conclusively established, though it is assumed that they are the effects of a vibration phenomenon. However, vibrations are virtually unavoidable in a calender.

Barring phenomena per se have also occurred earlier, namely with calender stacks, i.e., calenders that were equipped exclusively with hard rolls. However, in this case, the reasons for barring formation are assumed to lie in the paper web, i.e., the periodic occurrence of changes in thickness, which were caused, e.g., by a slightly pulsating headbox.

In the case of calender stacks, attempts have been made to prevent such a barring formation either by arranging a guide roll at alternating distances from the roll stack, or by laterally displacing one or more rolls from the press plane.

However, in the case of barring formation on soft rolls, in particular plastic rolls, this is a different phenomenon. Here it can be observed that the elastic surface layer changes by itself within a relatively short time. When a barring phenomenon occurs, the roll that exhibits the barring formation must be removed and reground or finished. The service life of such a roll is therefore limited.

In the barring formation, the soft roll is changed on its elastic surface. It has not yet been conclusively determined what this change actually entails. The following possibilities are currently assumed: the roll develops a waviness on the surface, i.e., a hill and valley structure, the roll becomes polygonal, or the roll alternately develops zones of varying surface quality in the circumferential direction, e.g., varying roughness. Regardless of the concrete type of change, after the barring formation, periodic stripes running in the axial direction appear on the circumference of the roll. Corresponding stripes then appear on the paper web, whereby the paper web is to be considered as waste, at the latest, by the time the stripes become visible.

SUMMARY OF THE INVENTION

According to the invention, the service life of such a roll is increased.

The invention is attained with a calender of the type mentioned at the outset in that at least one roll with an elastic surface features a displacement relative to the press plane, the size of which displacement is selected depending on the wavelength of a critical natural frequency within the roll stack.

The calender is therefore built from the outset so that at least one soft roll, with which a barring formation could occur without displacement, is displaced relative to the press plane. To this end, first a critical natural frequency of the calender is determined. A roll stack that is formed of several rolls has a plurality of natural frequencies. This does not refer to the natural frequencies of the individual rolls by themselves, such as, e.g., natural frequencies in bending, but the natural shapes of vibrations which result from the vibrating roll masses on the spring and damping systems of the interposed plastic coatings of the "soft" rolls. A running calender produces exciter forces, the frequencies of which are composed of the multiple of the roll rotational speeds. These exciter forces can be due to inhomogeneities, anisotropies or geometry errors (out of roundnesses). Fluctuations in paper thickness of the paper web running through the calender can also stimulate the roll stack. A paper web running into the calender is still very rough before the glazing process. In addition, a paper web is never free from basis weight or thickness fluctuations. If these fluctuations are analyzed with the aid of a FFT analysis of their frequencies, as a rule a wide-band noise is determined, which contains all the frequencies. If one of these exciter frequencies meets a natural frequency, the vibration system of the calender responds with enlarged vibration amplitudes. These resonance points cannot be constructively avoided because of the large number of possible exciters and the large number of possible natural shapes of vibrations. As a rule, the vibration system is also so greatly damped and the exciter forces are so small that the resulting vibration movements are not directly disruptive. Over a more or less extensive period of time, however, these vibration movements are impressed into the plastic coatings of the elastic rolls.

The integral multiples of the roll rotational frequency nearest to the natural frequency is usually impressed into the roll as a pattern. This results in a regeneration of the vibration. The vibration amplitudes then increase exponentially. They are expressed on the one hand in an increased noise level (up to more than 120 dB(A)), and on the other in periodic fluctuations in thickness of the paper web running through. Varying periods of time are observed in practice in which these regeneration phenomena, which are expressed in barrings, develop. Some days or weeks usually pass until this phenomenon has grown so much that it disrupts the production process.

Not all of these natural frequencies are critical. Frequencies that are relatively low do not usually have a disruptive effect on the rolls. Although frequencies that are relatively high can under certain circumstances produce barrings on the paper web, these crosswise stripes are so close together that they are basically impossible to distinguish. The natural vibrations can be calculated with known numerical procedures, e.g., with procedures that work with finite elements. Programs for this are commercially available. A program with which the natural vibrations can be calculated is available under the name "Ansys."

The displacement preferably causes a difference in distance of a quarter of a wavelength on the surface of the roll between two nips. This approach has several advantages. For one thing, the displacement is relatively small. As a rule, it is in the range of 10 mm, and often smaller, so that no change worth mentioning results in the geometry of the roll stack due to the displacement. It can therefore still be assumed that the forces of pressure also act in the press plane. However, above all, this embodiment has the advantage that a barring formation does not occur at the critical natural frequency or at least is significantly delayed. This is based on the following consideration. Over time, only those wavelengths can add up on a roll circumference whose integral multiple is the same as the roll circumference. All other wavelengths erase themselves with time. Accordingly, integral multiples of the roll rotational frequencies that are close to a natural frequency are possible frequencies that develop as barring. However, the number of developing wavelengths does not depend only on the proximity to the natural frequency, but also on the vibration shape. The vibration shape is decisive for whether an even integral multiple or an odd integral multiple of the roll rotational frequency develops. With an even multiple, the elastic roll is loaded from both sides as it were at each wave. With an odd multiple, a load on one side is opposed by an unloading on the other side. If a difference in distance of a quarter wavelength is made on the surface of the roll, a phase shift of the waves by $\pi/2$ occurs. In this case the two nips in which the soft roll is involved are no longer directly coupled. A regenerative coupling of the individual nips to themselves can only be disrupted by a time change of the roll rotational speed.

The displacement is preferably an eighth of a wavelength. The difference in distance of a quarter of a wavelength on the surface of the roll can be produced by adding (on one half of the roll) or removing (on the other half of the roll) an eighth of a wavelength at each nip. The displacement can thus be kept relatively small overall.

The roll preferably features an adjusting device with the aid of which the displacement is adjustable on the basis of a preset displacement, which depends on the wavelength. Such an adjusting device is particularly advantageous in the case of calenders exhibiting several critical natural frequencies. Although in this case the development of barrings based on a natural frequency can be prevented or delayed with the roll displacement as originally set, barrings will possibly develop which are based on a different natural frequency. If there is the possibility of changing the roll displacement, one can optionally switch back and forth between several positions of the rolls, in order to disrupt the development of barrings at all critical natural frequencies.

The calender preferably exhibits only one critical natural frequency in a predetermined frequency range. This can be achieved in constructive ways, e.g., by the selection of suitable diameter combinations of the rolls. If only one natural frequency occurs in the critical range, combating barrings by displacement can be implemented relatively reliably.

The invention is attained by a process of the type mentioned at the outset by determining the natural vibrations of the calender at the normal speed, selecting a critical natural vibration from the natural vibrations, determining a wavelength associated with the natural vibration, the integral multiple of which wavelength corresponds to the circumference of the roll, and by displacing the roll such that a difference in distance of a quarter of a wavelength occurs on the surface of the roll between two nips.

As described above in connection with the calender, with a difference in distance of a quarter wavelength on the surface of the roll, a phase shift of $\pi/2$ occurs in the two nips when the roll is acted upon. In this case the two nips no longer couple together directly. If it is assumed that given otherwise identical excitation vibrations are impressed in the individual nips with only half the intensity, when there is no regenerative coupling of the two nips to each other, it must be theoretically possible to at least double the service life.

An odd multiple is preferably chosen. As a rule, a wavelength which is associated exactly with one natural frequency is not an integral fraction of the circumference of the roll. Thus, in the neighborhood of this "exact" wavelength, there are two wavelengths that could be critical. One of the wavelengths equals the roll circumference when multiplied by an even whole number. The other wavelength equals the roll circumference when it is multiplied by an odd whole number. Thus, the wavelength is selected which equals the circumference of the roll when multiplied by an odd number. It has been shown that in this way a longer service life is achieved for the elastic rolls.

The natural frequency is preferably divided by the rotational frequency of the roll, thus producing a theoretical barring number as quotient, whereby the multiple is the nearest whole number to the theoretical barring number. This is a relatively simple way of determining the multiple. It has been shown that good results are obtained with this multiple.

The roll is preferably displaced by an eighth of a wavelength. As explained above in connection with the calender, this is sufficient to effect a difference in distance of a quarter of a wavelength at both nips together.

The set displacement is preferably changed. This provides a possibility for correction even during the operation of the calender, if necessary during working breaks.

According to the invention, a calender with a roll stack comprises two end rolls in a press plane and at least one middle roll between the two end rolls. The at least one middle roll has a displacement (x) relative to the press plane, the size of the displacement (x) being selected based on a wavelength of a critical natural frequency within the roll stack.

According to another aspect of the invention, the at least one middle roll may comprise a plurality of middle rolls. The end rolls and the at least one middle roll may define two nips therebetween, the displacement (x) effecting a difference in distance of a quarter of a wavelength on a surface of the at least one middle roll between the two nips.

According to yet another aspect of the invention, the least one middle roll further comprises an adjusting device for adjusting its displacement on the basis of a preset displacement (x), which depends on the wavelength. The at least one middle roll having a displacement (x) may have an elastic surface. The displacement (x) may have an eighth of a wavelength.

Moreover, according to the invention, the at least one middle roll is supported in a bearing housing located at a front end of a lever. The lever may be supported with a bearing point in an eccentric bushing. Upon rotation of the eccentric bushing, the position of the at least one middle roll may be changed in a horizontal direction.

Alternatively, according to the invention, the lever may be supported in a sliding block which is movable by a linear drive in a housing. The linear drive may comprise a threaded spindle for attaining precise adjustment movements.

According to another alternative, the lever may be adjustable in length. The lever may comprise one of a telescopic and a prismatic guide. The lever may comprise two parts which are shiftable in opposite directions. The lever may be movable via a threaded spindle.

According to yet another alternative of the invention, the bearing housing may be connected to the lever via a swivel joint. The swivel joint may be arranged at a lower end of a fastening plate which, in turn, is attached to the lever. The swivel joint may be arranged at an upper end of a fastening plate which, in turn, is attached to the lever.

Moreover, according to the invention, a tilting gearing is provided for tilting, by a defined amount, the bearing housing relative to the lever.

According to the invention, the roll stack exhibits only one critical natural frequency in a predetermined frequency range.

According to another aspect of the invention, a calender with a roll stack comprises two end rolls in a press plane and a plurality of middle rolls between the two end rolls. At least one of the middle rolls has an elastic surface and has a displacement (x) relative to the press plane, the size of the displacement (x) being selected based on a wavelength of a critical natural frequency within the roll stack. The end rolls and the at least one middle roll define two nips therebetween, the displacement (x) effecting a difference in distance of a fraction of a wavelength on a surface of the at least one middle roll between the two nips. An adjusting device is provided for adjusting the displacement of the at least one middle roll on the basis of a preset displacement (x), which depends on the wavelength.

According to yet another aspect of the invention, a process for arranging rolls in a roll stack of a calender including two end rolls in a press plane and a plurality of middle rolls therebetween, at least one of the middle rolls including an elastic surface, and running in operation at a normal speed, includes determining the natural vibrations of the calender at the normal speed, selecting a critical natural vibration from the natural vibrations, determining a wavelength associated with the natural vibration, the integral multiple of which wavelength corresponds to a circumference of at least one middle roll, and displacing the at least one middle roll in a manner that a difference in distance of a quarter of a wavelength occurs on a surface of the at least one middle roll between two nips.

The selecting may comprise selecting an odd number multiple. The natural frequency may be divided by the rotational frequency of the at least one middle roll, and a theoretical barring number may be obtained as a quotient, whereby the multiple is the nearest whole number to the theoretical barring number. The displacing of the at least one middle roll may be by an eighth of a wavelength. A set displacement may be changed.

The instant application expressly incorporates by reference in their entireties, the disclosures of commonly owned and concurrently filed herewith applications P22425 (Applicant's docket number) entitled "PROCESS FOR OPERATING A CALENDER"; P22427 (Applicant's docket number) entitled "CALENDER AND PROCESS FOR OPERATING A CALENDER"; and P22431 (Applicant's docket number ) entitled "PROCESS FOR OPERATING A CALENDER".

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
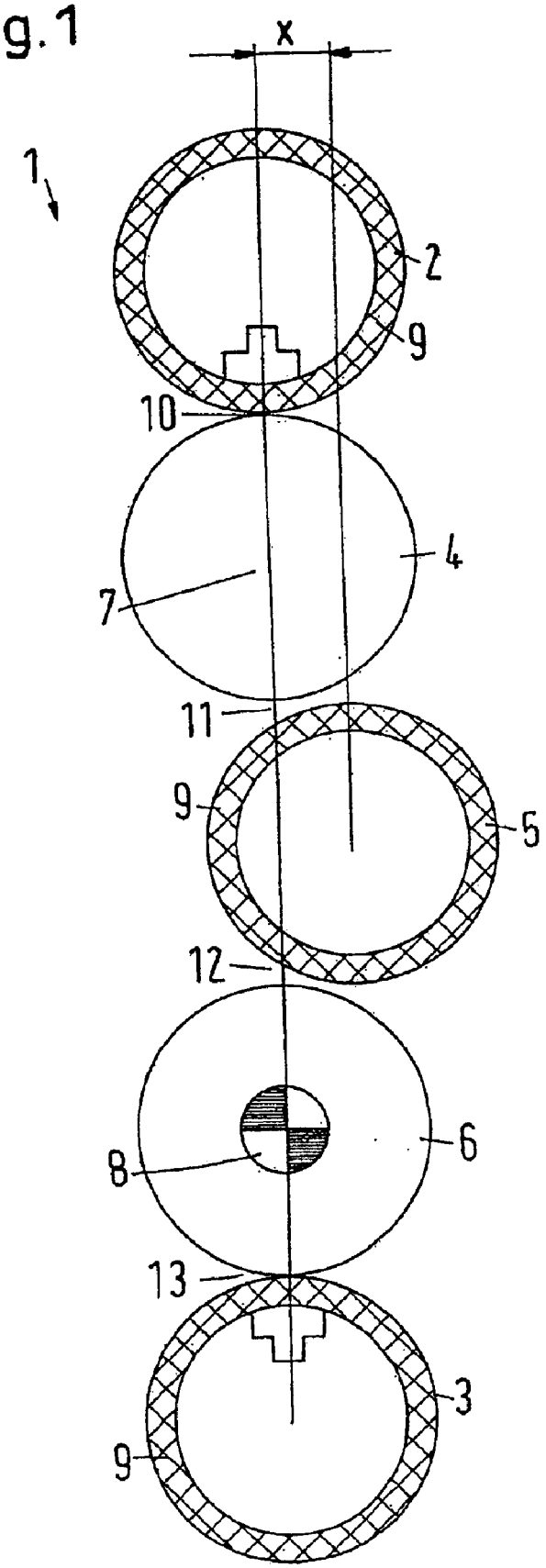
FIG. 1 shows a diagrammatic representation of a calender.

FIG. 1 shows a diagrammatic representation of a calender 1 with two end rolls 2, 3 which are embodied as load-deflection rolls, and three middle rolls 4–6, which together form a roll stack. The roll stack features a roll plane 7, in which the axes of all rolls 2–6 lie when the rolls 2–6 are arranged exactly above one another. The press direction, i.e., the direction in which the rolls 2–6 are pressed against one another, also lies in this roll plane 7 for the purposes of the following description.

Further details of the calender are represented only in diagrammatic form, such as a drive 8, or omitted completely, such as heating individual rolls. However, the two end rolls 2, 3 and the centermost roll 5 feature an elastic coating 9, which is shown with exaggerated thickness.

During the operation of the calender, the rolls 2–6 form nips 10–13 in a known manner, through which nips a material web to be treated is guided. All the nips are embodied here as so-called soft nips, since they are limited by one hard and one soft roll.

The middle roll 5 is displaced by a distance (x). The distance (x) accordingly forms a displacement of the roll. This displacement is calculated beforehand. The necessary considerations for this will be explained in relation to FIG. 3.

Figure 3:
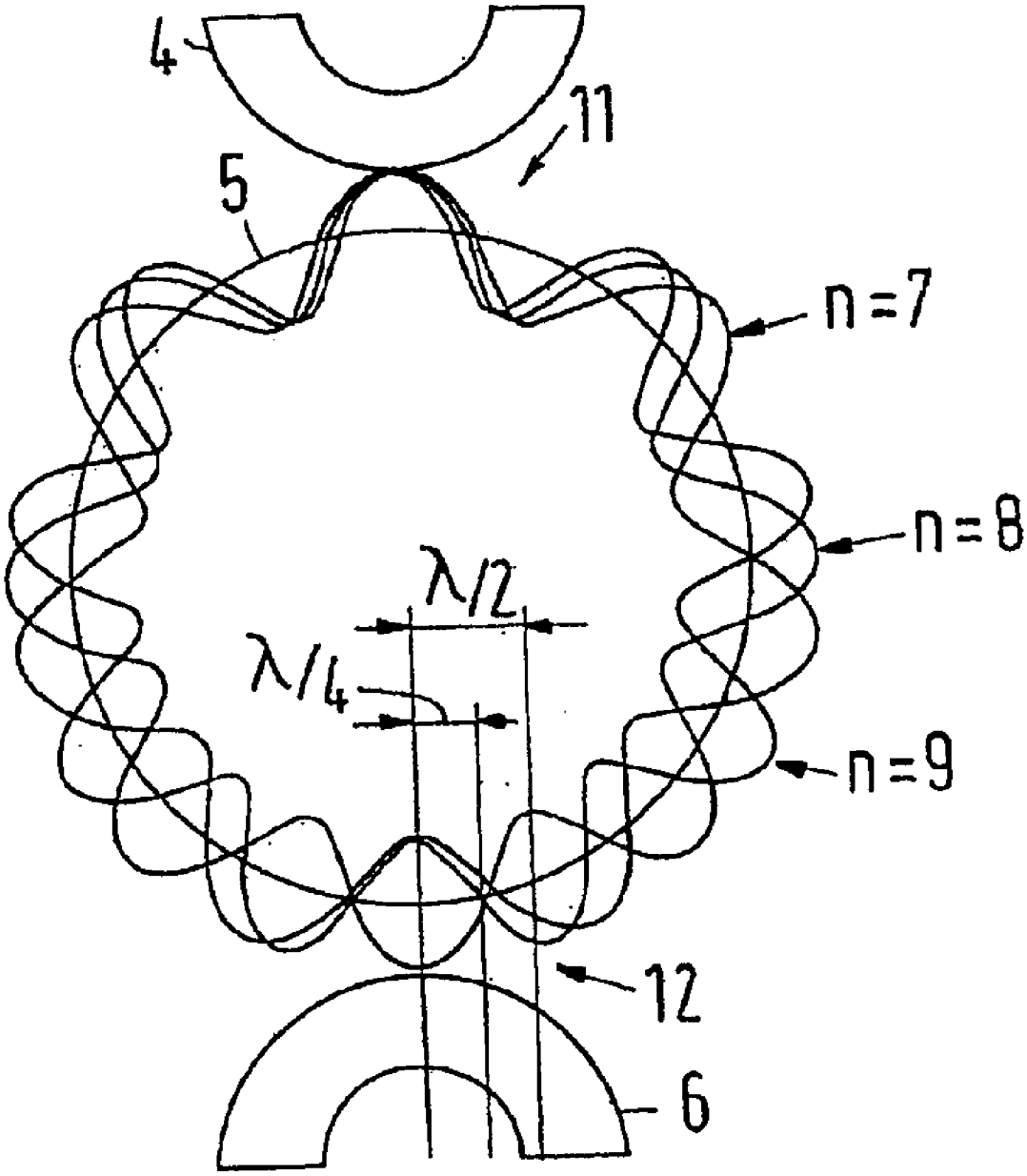
FIG. 3 shows a diagrammatic representation for explaining the development of a barring pattern.

FIG. 3 shows the roll 5, the roll 4 located above it, and the roll 6 located below it. Various reference wavinesses are represented with exaggerated amplitudes, namely a waviness in which seven waves run around the circumference of the roll 5, one with eight waves and one with nine waves. The numbers n=7, 8, 9 were chosen for reasons of clarity. In the case of real rolls, a correspondingly higher number of waves develop over the circumference of the roll, e.g., in the range of 30 to 50. In the case of such a high number of waves running around the circumference of the roll 5, it can be assumed in a first approximation that in the case of a small displacement movement of the roll 5 relative to the roll plane 7 that is smaller than a wavelength, the curvature of the roll 5 does not matter.

It is achieved by the displacement (x) that the distance between the two nips 11, 12 is increased by a quarter of a wavelength $\lambda/4$ on the one side and reduced by this quarter of a wavelength $\lambda/4$ on the other side. To this end only a displacement (x) is necessary, where $(x)=\lambda/8$, because this results in the desired difference in distance between the two nips 11, 12.

Through the static roll displacement, which effects a difference in distance of a quarter of a wavelength $\lambda/4$ between the two nips 11, 12, it can be assumed that with the same excitation by the coupling with the two neighboring roils, the disruptions are impressed separately from one another with half the intensity, so that it is theoretically possible to double the service life.

The procedure for calculating the displacement is now to be explained on the basis of an example. The calender should feature a normal speed of 1,280 m/min, i.e., all the rolls should rotate at a circumferential speed of 1,280 m/min. It is hereby assumed that the roll 4 has a diameter of 870 mm, the roll 5 a diameter of 874 mm and the roll 6 a diameter of 878 mm. The roll circumference is accordingly calculated as 2,733.1855 mm, 2,745.7520 mm, and 2,758.3184 mm.

It was determined beforehand with a finite elements procedure that a natural system frequency fe of 277.3120 Hz exists, whereby the natural system frequency shape is asymmetrical to the roll 5.

A roll rotational frequency fw of 7.8053 Hz, 7.7696 Hz or 7.7342 Hz is calculated for the rolls 4, 5, 6 from the above-mentioned roll circumferences and the intended production speed, i.e., the normal speed. A theoretical barring number of 35.5287, 35.6920 and 35.8554 thus results for the rolls 4, 5, 6 from the quotient fe/fw. The nearest whole odd number is taken as the nearest barring number. This is the number 35. Without the displacement, it would be assumed that a barring pattern would develop on the roll 5 with a wavelength that corresponds to the circumference (2,745.752 mm) divided by 35, i.e., a wavelength of 78.4501 mm.

If the roll 5 is now displaced by the roll displacement X=78.4501 mm/8=9.8063 mm, it can be assumed with a very high degree of probability that a barring formation with this wavelength will not appear or only appear very late. The service life of the elastic roll 5 is drastically increased by the displacement (x).

The calender 1 according to FIG. 1 is designed such that it exhibits only one natural system frequency fe of 277.3120 Hz in the critical range. The critical range in this case is a frequency range in which barrings can occur. Frequencies above or below this range are at any rate uncritical for the barring formation.

If a calender 1 exhibits several critical frequencies, steps can be taken from the start to render possible an adjustment of the displacement even after the formation of the roll stack. Examples of this are provided in FIGS. 2*a*–2*d*.

FIGS. 2*a*–2*d* show various possibilities for effecting the roll displacement. The explanation is given in all cases based on the example of the middle roll 5, which is supported in a bearing housing 30 that is located at the front end of a lever 31.

Figure 2A:
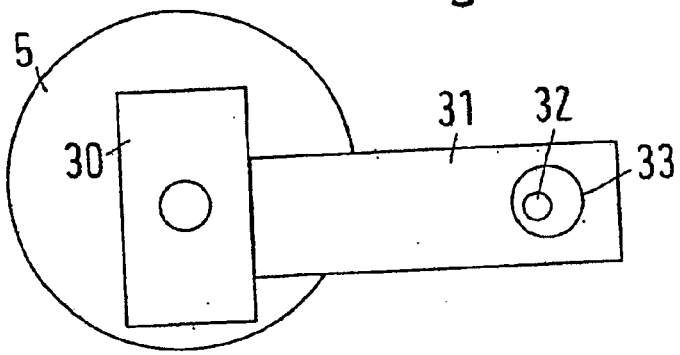
FIGS. 2*a*–2*d* show various possibilities for setting a displacement of a roll.

In the exemplary embodiment according to FIG. 2*a*, the lever 31 is supported with a bearing point 32 in an eccentric bushing 33. When the eccentric bushing 33 is rotated, the position of the roll 5 is changed in the horizontal direction.

Figure 2B:
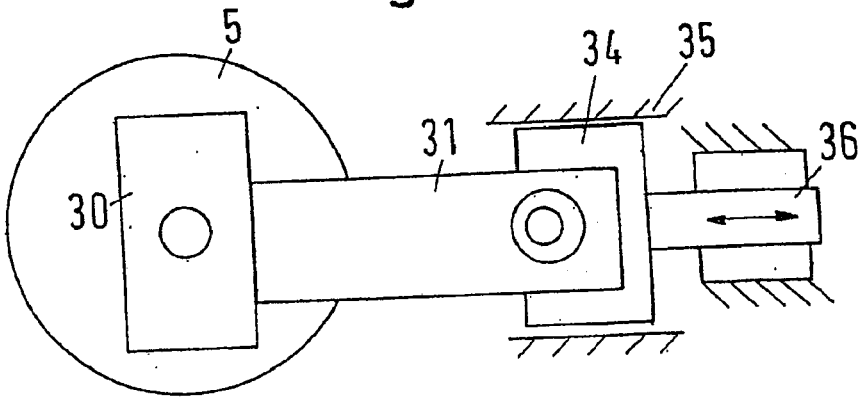

In the exemplary embodiment according to FIG. 2*b*, the lever 31 is supported in a sliding block 34, which can be moved in a housing 35 by a linear drive 36 (shown only diagrammatically). The linear drive can be implemented, e.g., as a threaded spindle. Relatively precise adjustment movements are also possible with a threaded spindle.

Figure 2C:
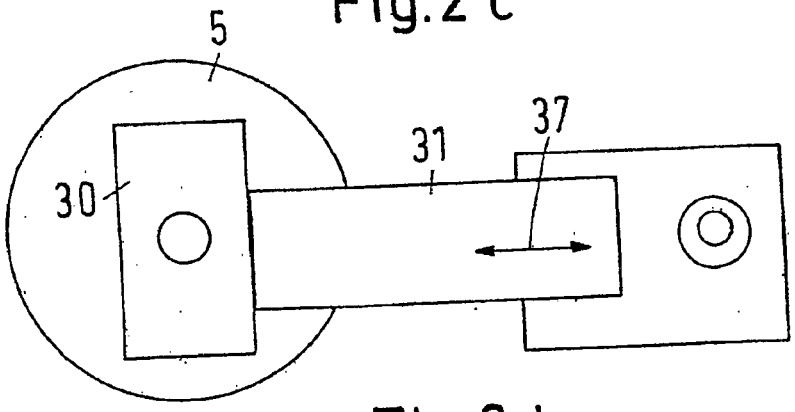

In the exemplary embodiment according to FIG. 2*c*, the lever 31 is embodied as adjustable in length, which is represented by a double arrow 37. The lever 31 can feature, e.g., a telescopic or a prismatic guide. The two parts of the lever that can be shifted in opposition, can likewise be driven via a threaded spindle (not shown in detail).

Figure 2D:
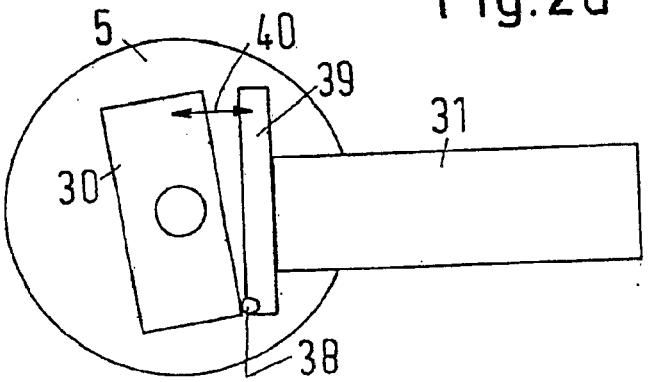

In the exemplary embodiment according to FIG. 2*d*, the bearing housing 30 is connected to the lever 31 via a swivel joint 38. The swivel joint 38 is arranged at the lower end of a fastening plate 39 which, in turn, is attached to the lever 31. Of course, an attachment at the upper end is also possible. A diagrammatically represented tilting gearing 40 is provided in order to tilt the bearing housing 30 relative to the lever 31 by a defined amount.

The adjusting path is hereby designed so that it leads to a displacement X from the press plane 7 or into it, which in turn is sufficient to disturb or to eliminate the development of a barring pattern on the surface of the elastic roll. To remove a barring pattern it can be useful to select the displacement $(x)=\lambda/4$, i.e., to cause a difference in distance of $\lambda/2$ on the surface of the roll 5, whereby $\lambda$ is the wavelength of the newly occurring barring pattern.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. Calender with a roll stack having a critical natural frequency during operation determined at least by roll speed and circumference, the calender comprising:

two end rolls in a press plane;

at least one middle roll between the two end rolls;

said at least one middle roll having a displacement (x) relative to the press plane, the size of the displacement (x) being selected based on a wavelength of the critical natural frequency within the roll stack; and one of:

the displacement (x) of said at least one middle roll at least significantly delays barring formation;

the displacement (x) of said at least one middle roll disrupts development of barrings; and the displacement (x) of said at least one middle roll prevents barring formation from occurring.

2. The calender according to claim 1, further comprising additional middle rolls.

3. The calender according to claim 2, wherein the least one middle roll further comprises an adjusting device for adjusting its displacement on the basis of a preset displacement (x), which depends on the wavelength.

4. The calender according to claim 2, wherein said at least one middle roll having a displacement (x) has an elastic surface.

5. The calender according to claim 4, wherein the displacement (x) is an eighth of a wavelength.

6. The calender according to claim 4, wherein the least one middle roll further comprises an adjusting device for adjusting its displacement on the basis of a preset displacement (x), which depends on the wavelength.

7. The calender according to claim 1, wherein the displacement (x) is an eighth of a wavelength.

8. The calender according to claim 1, wherein the at least one middle roll further comprises an adjusting device for adjusting its displacement on the basis of a preset displacement (x), which depends on the wavelength.

9. The calender according to claim 8, wherein the at least one middle roll is supported in a bearing housing located at a front end of a lever.

10. The calender according to claim 1, wherein the roll stack exhibits only one critical natural frequency in a predetermined frequency range.

11. Calender with a roll stack having a critical natural frequency during operation determined at least by roll speed and circumference, the calender comprising:

two end rolls in a press plane;

at least one middle roll between the two end rolls;

said at least one middle roll having a displacement (x) relative to the press plane, the size of the displacement (x) being selected based on a wavelength of the critical natural frequency within the roll stack;

additional middle rolls; and one of:

the displacement (x) of said at least one middle roll at least significantly delays barring formation;

the displacement (x) of said at least one middle roll disrupts development of barrings; and the displacement (x) of said at least one middle roll prevents barring formation from occurring, wherein said end rolls and said at least one middle roll define two nips therebetween, the displacement (x) effecting a difference in distance of a quarter of a wavelength on a surface of the at least one middle roll between said two nips.

12. Calender with a roll stack having a critical natural frequency during operation determined at least by roll speed and circumference, the calender comprising:

two end rolls in a press plane;

at least one middle roll between the two end rolls;

said at least one middle roll having a displacement (x) relative to the press plane, the size of the displacement (x) being selected based on a wavelength of the critical natural frequency within the roll stack;

additional middle rolls; and one of:

the displacement (x) of said at least one middle roll at least significantly delays barring formation;

the displacement (x) of said at least one middle roll disrupts development of barrings; and the displacement (x) of said at least one middle roll prevents barring formation from occurring, wherein said at least one middle roll having a displacement (x) has an elastic surface, and wherein said end rolls and said at least one middle roll define two nips therebetween, the displacement (x) effecting a difference in distance of a quarter of a wavelength on a surface of the at least one middle roll between said two nips.

13. Calender with a roll stack having a critical natural frequency during operation determined at least by roll speed and circumference, the calender comprising:

two end rolls in a press plane;

at least one middle roll between the two end rolls;

said at least one middle roll having a displacement (x) relative to the press plane, the size of the displacement (x) being selected based on a wavelength of the critical natural frequency within the roll stack; and one of:

the displacement (x) of said at least one middle roll at least significantly delays barring formation;

the displacement (x) of said at least one middle roll disrupts development of barrings; and the displacement (x) of said at least one middle roll prevents barring formation from ocurring, wherein said end rolls and said at least one middle roll define two nips therebetween, the displacement (x) effecting a difference in distance of a quarter of a wavelength on a surface of the at least one middle roll between said two nips.

14. The calender according to claim 13, wherein the displacement (x) is an eighth of a wavelength.

15. The calender according to claim 13, wherein the least one middle roll further comprises an adjusting device for adjusting its displacement on the basis of a preset displacement (x), which depends on the wavelength.

16. Calender with a roll stack having a critical natural frequency during operation determined at least by roll speed and circumference, the calender comprising:

two end rolls in a press plane;

at least one middle roll between the two end rolls;

said at least one middle roll having a displacement (x) relative to the press plane, the size of the displacement (x) being selected based on a wavelength of the critical natural frequency within the roll stack;

an adjusting device for adjusting a displacement of the at least one middle roll on the basis of a preset displacement (x). which depends on the wavelength; and one of:

the displacement (x) of said at least one middle roll at least significantly delays barring formation;

the displacement (x) of said at least one middle roll disrupts development of barrings; and the displacement (x) of said at least one middle roll prevents barring formation from ocurring, wherein the at least one middle roll is supported in a bearing housing located at a front end of a lever, and wherein the lever is supported with a bearing point in an eccentric bushing.

17. The calender according to claim 16, wherein upon rotation of the eccentric bushing, the position of the at least one middle roll is changed in a horizontal direction.

18. Calender with a roll stack having a critical natural frequency during operation determined at least by roll speed and circumference, the calender comprising:

two end rolls in a press plane;

at least one middle roll between the two end rolls;

said at least one middle roll having a displacement (x) relative to the press plane, the size of the displacement (x) being selected based on a wavelength of the critical natural frequency within the roll stack;

an adjusting device for adjusting a displacement of the at least one middle roll on the basis of a preset displacement (x) which depends on the wavelength; and one of:

the displacement (x) of said at least one middle roll at least significantly delays barring formation;

the displacement (x) of said at least one middle roll disrupts development of barrings; and the displacement (x) of said at least one middle roll prevents barring formation from occurring, wherein the at least one middle roll is supported in a bearing housing located at a front end of a lever, and wherein the lever is supported in a sliding block which is movable by a linear drive in a housing.

19. The calender according to claim 18, wherein the linear drive comprises a threaded spindle for attaining precise adjustment movements.

20. Calender with a roll stack having a critical natural frequency during operation determined at least by roll speed and circumference, the calender comprising:

two end rolls in a press plane;

at least one middle roll between the two end rolls;

said at least one middle roll having a displacement (x) relative to the press plane, the size of the displacement (x) being selected based on a wavelength of the critical natural frequency within the roll stack;

an adjusting device for adjusting a displacement of the at least one middle roll on the basis of a preset displacement (x) which depends on the wavelength; and one of:

the displacement (x) of said at least one middle roll at least significantly delays barring formation;

the displacement (x) of said at least one middle roll disrupts development of barrings; and the displacement (x) of said at least one middle roll prevents barring formation from ocurring, wherein the at least one middle roll is supported in a bearing housing located at a front end of a lever, and wherein the lever is adjustable in length.

21. The calender according to claim 20, wherein the lever comprises one of a telescopic and a prismatic guide.

22. The calender according to claim 21, claim wherein the lever comprises two parts which are shiftable in opposite directions.

23. The calender according to claim 22, wherein the lever is movable via a threaded spindle.

24. Calender with a roll stack having a critical natural frequency during operation determined at least by roll speed and circumference, the calender comprising:

two end rolls in a press plane;

at least one middle roll between the two end rolls;

said at least one middle roll having a displacement (x) relative to the press plane, the size of the displacement (x) being selected based on a wavelength of the critical natural frequency within the roll stack;

an adjusting device for adjusting a displacement of the at least one middle roll on the basis of a preset displacement (x) which depends on the wavelength; and one of:

the displacement (x) of said at least one middle roll at least significantly delays barring formation;

the displacement (x) of said at least one middle roll disrupts development of barrings; and the displacement (x) of said at least one middle roll prevents barring formation from ocurring, wherein the at least one middle roll is supported in a bearing housing located at a front end of a lever, and wherein the bearing housing is connected to the lever via a swivel joint.

25. The calender according to claim 24, wherein the swivel joint is arranged at a lower end of a fastening plate which, in turn, is attached to the lever.

26. The calender according to claim 24, wherein the swivel joint is arranged at an upper end of a fastening plate which, in turn, is attached to the lever.

27. The calender according to claim 26, further comprising a tilting gearing for tilting, by a defined amount, the bearing housing relative to the lever.

28. Calender with a roll stack having a critical natural frequency during operation determined at least by roll speed and circumference, the calender comprising:

two end rolls in a press plane;

a plurality of middle rolls between the two end rolls;

at least one of the middle rolls having an elastic surface and having a displacement (x) relative to the press plane, the size of the displacement (x) being selected based on a wavelength of the critical natural frequency within the roll stack, wherein said end rolls and said at least one middle roll define two nips therebetween, the displacement (x) effecting a difference in distance of a fraction of a wavelength on a surface of the at least one middle roll between said two nips;

an adjusting device for adjusting the displacement of the at least one middle roll on the basis of a preset displacement (x), which depends on the wavelength.

* * * * *